US008926226B2

(12) United States Patent
Vandenbulcke et al.

(10) Patent No.: US 8,926,226 B2
(45) Date of Patent: Jan. 6, 2015

(54) DEVICE FOR MANUFACTURING A FOUNDATION FOR A MASS LOCATED AT HEIGHT, ASSOCIATED METHOD AND ASSEMBLY OF THE DEVICE AND A JACK-UP PLATFORM

(75) Inventors: Luc Vandenbulcke, Konitch (BE); Koen Vanderbeke, Erps-Kwerps (BE)

(73) Assignee: GeoSea N.V., Zwijndrecht (BE)

( * ) Notice: Subject to any disclaimer, the term of this patent is extended or adjusted under 35 U.S.C. 154(b) by 44 days.

(21) Appl. No.: 13/401,375

(22) Filed: Feb. 21, 2012

(65) Prior Publication Data

US 2012/0213594 A1 Aug. 23, 2012

(30) Foreign Application Priority Data

Feb. 22, 2011 (BE) ..... 2011/0122

(51) Int. Cl.

| | |
|---|---|
| ***E02D 7/00*** | (2006.01) |
| ***E02B 17/02*** | (2006.01) |
| ***E02D 13/04*** | (2006.01) |
| ***E02D 27/52*** | (2006.01) |
| *E02B 17/00* | (2006.01) |

(52) U.S. Cl.

CPC ..... *E02D 27/52* (2013.01); *E02B 17/021* (2013.01); *E02B 2017/0043* (2013.01); *E02B 2017/0082* (2013.01); *E02D 13/04* (2013.01); *E02B 2017/0039* (2013.01)

USPC ..... 405/228; 405/195.1; 405/204; 405/224; 405/227; 405/231; 166/352; 166/354; 166/358; 175/5; 175/7; 175/9; 175/220

(58) Field of Classification Search

CPC ..... E02B 2017/0043; E02B 2017/0082; E02B 2017/0039; E02D 13/04; E02D 27/52

USPC ..... 405/195.1, 196, 201, 203, 204, 224, 405/227, 228, 231; 166/352, 354, 358; 175/5, 7, 9, 10, 220

See application file for complete search history.

(56) References Cited

U.S. PATENT DOCUMENTS

| | | | |
|---|---|---|---|
| 4,084,385 | A | 4/1978 | Boyadjieff |
| 4,102,147 | A | 7/1978 | Jansz |

(Continued)

FOREIGN PATENT DOCUMENTS

| | | | |
|---|---|---|---|
| EP | 2067915 | A2 | 6/2009 |
| EP | 2309063 | A1 | 4/2011 |

(Continued)

*Primary Examiner* — John Kreck
*Assistant Examiner* — Carib Oquendo
(74) *Attorney, Agent, or Firm* — The Webb Law Firm

(57) ABSTRACT

The invention relates to a device for manufacturing a foundation for a mass located at height, such as the jacket of a wind turbine or a jetty, wherein the foundation comprises a quantity of piles driven into an underwater bottom in a geometric pattern. The device comprises a positioning framework of a number of mutually connected guide tubes arranged in a geometric pattern and adapted to receive and guide a pile to be driven into the underwater bottom, wherein the guide tubes comprise a mechanism with which at least an internal wall part of the guide tubes is displaceable in the radial direction of the guide tubes from a radially inward support position for the pile to a radially more outward position in which the internal wall part substantially releases the pile. The invention also relates to a method and an assembly of a jack-up platform and the device.

19 Claims, 14 Drawing Sheets

(56) References Cited

U.S. PATENT DOCUMENTS

| | | | | |
|---|---|---|---|---|
| 4,232,048 | A | | 11/1980 | Palm et al. |
| 4,509,883 | A | | 4/1985 | Thibodeaux et al. |
| 4,739,840 | A | | 4/1988 | Cox |
| 4,932,811 | A | | 6/1990 | Folding |
| 5,035,542 | A | * | 7/1991 | Bassett ..... 405/227 |
| 5,244,312 | A | | 9/1993 | Wybro et al. |

FOREIGN PATENT DOCUMENTS

| | | | |
|---|---|---|---|
| GB | 2054710 | A | 2/1981 |
| NL | 7512022 | | 4/1977 |
| NL | 7612022 | A | 4/1977 |
| WO | 03074795 | A1 | 9/2003 |
| WO | 2006109018 | A1 | 10/2006 |

* cited by examiner

DEVICE FOR MANUFACTURING A FOUNDATION FOR A MASS LOCATED AT HEIGHT, ASSOCIATED METHOD AND ASSEMBLY OF THE DEVICE AND A JACK-UP PLATFORM

BACKGROUND OF THE INVENTION

1. Field of the Invention

The invention relates to a device and a method for manufacturing a foundation for a mass located at height, such as the jacket of a wind turbine or a jetty, wherein the foundation comprises a quantity of piles driven into an underwater bottom in a geometric pattern. The invention also relates to an assembly of a jack-up platform and a device coupled thereto with which the method can be performed.

2. Description of the Prior Art

The invention will be elucidated hereinbelow with reference to an offshore wind turbine. The reference to a wind turbine in no way implies that the invention is limited to the use in the context of such a wind turbine. The positioning framework and the method can likewise be applied on any other structure, such as jetties, radar and other towers, platforms and the like. The support structure of a wind turbine normally has a slender design, for instance in the form of a tube or pillar. This pillar structure has to be coupled to a foundation in the ground. For offshore wind turbines, which are placed in relatively shallow water, it is possible to make use of one mast extending from the machinery housing of the wind turbine to the foundation. In addition to such a monopole construction, the support structure of an offshore wind turbine can also comprise a tubular upper part and a lower part in the form of a lattice structure, also referred to as a jacket. A large part of the jacket extends underwater, where the jacket finds support on an underwater bottom, in many cases the underwater bottom. Another option is a support structure in the form of a tripod.

A known method for providing a foundation for a mass located at height, such as the jacket of a wind turbine, comprises of providing an offshore platform in the vicinity of the location provided for the foundation, determining the location for each pile, subsequently manipulating each pile using a lifting crane present on the platform and driving each pile into the underwater bottom. Once all the piles have been arranged in the underwater bottom in the desired geometric pattern, thus forming the foundation, the jacket is arranged on the foundation formed by the quantity of piles by arranging legs of the jacket in the piles (also referred to as pin piling) or, in an alternative method, around the piles (also referred to as sleeve piling). The piles are adapted in both cases to be able to receive the legs of the jacket, for instance by providing hollow piles (pin piling) or hollow legs of the jacket (sleeve piling).

It will be apparent that it is of the greatest importance to not only urge the piles into the ground at the correct positions (the horizontal distance between the foundation piles must thus preferably be accurate to several centimeters), but also to ensure that the piles are arranged substantially at a perpendicular angle in the underwater bottom. In view of the large dimensions of structures such as wind turbines, it is only possible in many cases to allow a maximum variation of 1° relative to the vertical direction.

The invention has for its object to provide a device and method for providing a foundation as elucidated above with a greater accuracy than with the known device and method.

SUMMARY OF THE INVENTION

The invention provides for this purpose a device which comprises a positioning framework of a number of mutually connected guide tubes arranged in a geometric pattern and adapted to receive and guide a pile to be driven into the underwater bottom, wherein the guide tubes comprise a mechanism with which at least an internal wall part of the guide tubes is displaceable in the radial direction of the guide tubes from a radially inward support position for the pile to a radially more outward position in which the internal wall part substantially releases the pile. The guide tubes of the positioning framework are adapted to receive and guide piles when they are driven into the underwater bottom. At least an internal wall part of the guide tubes will here be situated in a radially inward support position for the pile, in which position the guide tubes have a smallest cross-section which is little larger than the cross-section of the piles, so that the piles at least find support against the internal wall part of the guide tubes. In order to enable easy removal of the positioning framework once the piles have been arranged in the underwater bottom, the positioning framework is preferably raised from a platform to a higher position, preferably guided by the spud poles, wherein during removal of the positioning framework the internal wall part of the guide tubes is situated in a radially more outward position in which the internal wall part substantially releases the pile. The device according to the invention makes it possible to arrange the piles accurately in the underwater bottom, both in respect of their position and in respect of their angle of inclination relative to the vertical direction. The positioning framework can moreover be easily removed by applying displaceable internal wall parts. An alternative method, wherein an internal wall part were to be situated fixedly at a smaller radius over a top part of the guide tubes, could consist of driving the piles so far through the guide tubes that the top of the piles extends further than the underside of the internal wall part. A drawback of such a method is that the guide tubes have to have a great height, and this does not enhance the stability, weight and ease of manipulation of the positioning framework. This is certainly the case when the foundation piles have to have a relatively large protrusion length (above the underwater bottom). The device according to the invention does not have these drawbacks and can, if desired, comprise relatively short guide tubes.

It is not unusual to provide the upper peripheral edge of foundation piles with welded protrusions, such as a weld bead, in order to improve for instance the attachment with grouting. Such protrusions make the guiding in the guide tubes more difficult. The device according to the invention also provides a solution herefor by displacing the internal wall part if desired and hereby leaving space for passage of the protrusions.

In a preferred embodiment of the device the internal wall part extends over practically the whole length of the guide tubes. The guide tubes can hereby be of relatively short length, which is advantageous. The guide tubes preferably have a height (the dimension in the longitudinal direction of the guide tubes) of at least 1 m, more preferably at least 3 m and most preferably at least 5 m, in order to further be able to guarantee the desired guiding function and vertical alignment of the foundation piles. The advantage of the invention becomes most clearly manifest when the height of the guide tubes does not rise above 10 m.

In order to further improve the guiding of the foundation piles it is recommended that the device according to the invention is characterized in that the internal wall part of the guide tubes comprises support ribs extending substantially in the longitudinal direction of the guide tubes.

An internal wall part of the guide tubes can be made displaceable in the radial direction of the guide tubes in any manner. A preferred embodiment of the device according to the invention comprises a positioning framework, the guide tubes of which comprise recesses in the peripheral casing thereof, in which recesses the support ribs can be received. Such an embodiment allows control of the displacement of the support ribs via the outer side of the guide tubes, this for instance improving accessibility in the case of malfunction. The mechanism will generally also be situated outside the guide tubes in this embodiment, this reducing the risk of damage.

In a first preferred embodiment the mechanism comprises a hinged plate which is coupled pivotally to the guide tubes and to which a support rib is attached, wherein the hinged plate is adapted, by means of rotation around a horizontal axis, to displace the support rib connected thereto from the radially inward support position to the radially more outward position.

In a second preferred embodiment the mechanism comprises a ring which is arranged around the peripheral surface of the guide tubes and which is coupled along its inner periphery to the support ribs, wherein the radius of the inner periphery varies in peripheral direction so that a support rib is displaced in radial direction when the ring is rotated.

In a third preferred embodiment the mechanism comprises a ring which is arranged round the peripheral surface of the guide tubes and which is provided along its inner periphery with the support ribs, and which can be divided into two or more ring parts so that a support rib is displaced in radial direction when the ring is divided.

The positioning framework can be moved along and under the guidance of the spud poles by any means known to the skilled person. It is thus possible for instance to suspend the positioning framework from a number of traction cables, wherein the cables can be varied in length by for instance winches arranged on the work deck of the platform. The cable length can be shortened or lengthened using the winches, wherein the positioning framework is respectively lifted or lowered.

In a preferred embodiment of the method according to the invention the positioning framework is further provided with means for guiding the positioning framework along the spud poles of an offshore platform from a high position in the immediate vicinity of the work deck of the platform to a lower position, optionally onto or into the immediate vicinity of the underwater bottom. The guide means are preferably adapted such that they can guide the positioning framework along the spud poles of the platform so that the positioning framework is aligned substantially horizontally in the lower position. This can for instance take place by suspending the positioning framework by means of three, four or even more cables, wherein each cable can be varied in length independently of the other cables by winches. This is particularly important in the case of an underwater bottom which is not wholly flat. The number of cables generally depends on the form of the positioning framework.

The positioning framework according to the invention preferably comprises a lattice structure with a number of guide tubes which are disposed spaced apart at the corner points thereof and which are connected by tubular lattice elements. The dimensions of the positioning framework in the plane are in principle larger than the dimensions out of the plane, wherein the direction out of the plane corresponds to a direction parallel to the lifting or lowering direction of the positioning framework. The guide tubes are adapted to receive and guide the piles for driving into the underwater bottom, and preferably comprise cylindrical casings, the longitudinal axis of which runs parallel to the direction of the positioning framework out of the plane. The guide tubes are arranged in a geometric pattern, this pattern corresponding to the desired geometric pattern of the foundation piles. The tubular lattice elements extending between the guide tubes ensure that guide tubes remain substantially in their position during lifting and lowering of the positioning framework. In the present embodiment the positioning framework is adapted to define a specific geometric pattern of the foundation piles. It is however also possible to make the positioning framework geometrically adaptable, for instance by providing the positioning framework with lattice elements adjustable in length and/or by providing the positioning framework with nodes which mutually connect lattice elements and allow adjustment of the angle between lattice elements. Such an embodiment allows realization of different geometric patterns of the foundation piles.

A preferred embodiment of the method according to the invention comprises of firstly establishing the position for at least one pile and positioning the assembly of platform and positioning framework such that at least one guide tube of the positioning framework is situated directly above said pile position. The arranging of a first pile through the at least one guide tube fixes the positioning framework. In such a position the guide tubes for the other piles will automatically be located in their correct positions because their relative positions are determined by the geometric design of the positioning framework. A position determination for each individual pile is hereby no longer necessary.

In another preferred embodiment of the method according to the invention, wherein the work deck of the platform is provided with at least one opening which is adapted for passage of a pile and which is vertically aligned with one of the guide tubes of the positioning framework, an assembly of platform and positioning framework is positioned such that the opening (also referred to as moon pool) is located directly above said pile position and is aligned with one of the guide tubes. In such an embodiment the positioning framework is placed at least partially overlapping with the jack-up platform (preferably on the underside of the platform), wherein a significant part of the platform is overlapped. Arranging a first pile through the opening and the corresponding guide tube fixes the positioning framework in respect of the platform.

The foundation piles can be arranged in the underwater bottom in any manner, such as for instance by means of a pneumatic or hydraulic hammer, generally from the platform.

In another aspect of the invention a method is provided comprising the step of removing the positioning framework once the piles have been arranged in the underwater bottom, wherein the removal of the positioning framework is performed by lifting thereof with guiding by the spud poles from the lower position to the high position in the vicinity of the work deck of the platform.

The invention further relates to a method for installing on a foundation a mass located at height, such as the jacket of a wind turbine or a jetty, wherein the foundation comprises a number of piles arranged by means of the above described method in an underwater bottom, the method comprising of arranging legs of the mass located at height into or around the piles and anchoring the legs to the piles by means of grouting.

In yet another aspect of the invention an assembly of a jack-up platform and a positioning framework coupled to the platform is provided wherein the positioning framework comprises a number of mutually connected guide tubes arranged in a geometric pattern and adapted to receive and guide a pile to be driven into the underwater bottom, wherein the guide tubes comprise a mechanism with which at least an internal wall part of the guide tubes is displaceable in the radial direction of the guide tubes from a radially inward support position for the pile to a radially more outward position in which the internal wall part substantially releases the pile, and wherein the positioning framework is provided with means for guiding the positioning framework along the spud poles of the platform from a high position in the immediate vicinity of the work deck of the platform to a lower position, optionally onto or into the immediate vicinity of the underwater bottom.

The advantages of such an assembly have already been discussed above in the context of the method and will therefore not be repeated here.

In another preferred embodiment of the invention an assembly is provided in which the work deck of the platform is provided with at least one opening which is adapted for passage of a pile and which is vertically aligned with one of the guide tubes of the positioning framework. Such an opening (or moon pool) will have a cross-section large enough for passage of a pile. The method according to the invention is particularly suitable for application with cylindrical (optionally) hollow foundation piles having an outer diameter of at least 1.2 m, more preferably at least 1.5 m, and most preferably at least 1.8 m, and with an (optional) wall thickness of 0.01 to 0.1 m, more preferably of 0.02 to 0.08 m, and most preferably of 0.04 to 0.06 m. A particularly suitable assembly according to the invention comprises at least one circular opening with a diameter of at least 1.5 m, more preferably at least 2.5 m and most preferably at least 3.0 m.

The method according to the invention is further particularly suitable for cylindrical (hollow) foundation piles with a length of more than 20 m, more preferably at least 25 m and most preferably at least 30 m, and a weight of 20 to 250 tonnes, more preferably of 60 to 200 tonnes and most preferably of 75 to 180 tonnes.

BRIEF DESCRIPTION OF THE DRAWINGS

The invention will now be elucidated in more detail with reference to the drawings, without otherwise being limited thereto. In the figures.

DETAILED DESCRIPTION OF THE PREFERRED EMBODIMENTS

Figure 1:
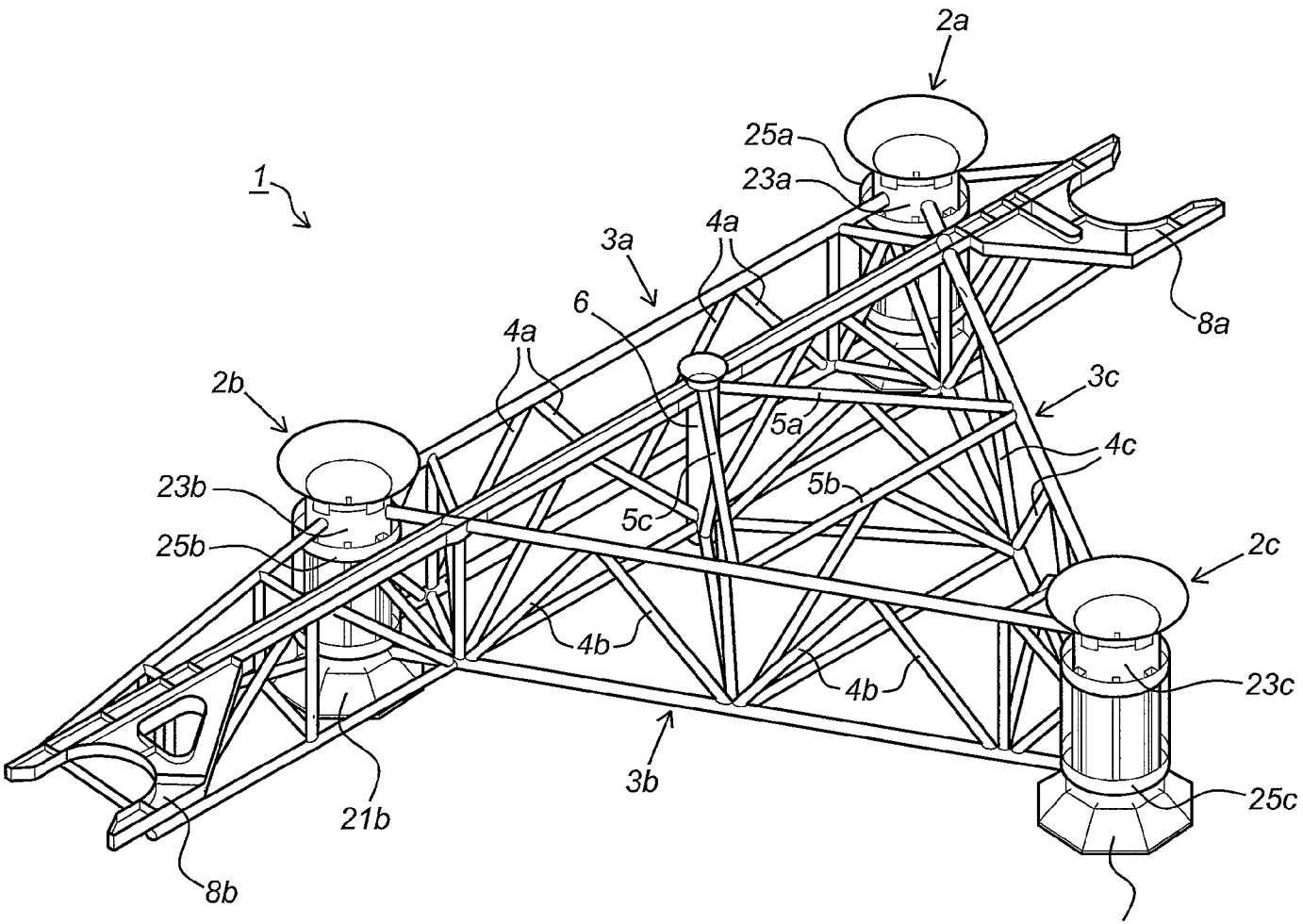
FIG. 1 shows a schematic perspective view of an embodiment of the device according to of the invention.

Shown with reference to FIG. 1 is a device according to the invention in the form of a positioning framework 1 which comprises at the corner points three cylindrical guide tubes (2*a*, 2*b*, 2*c*) adapted to receive and guide a pile. Guide tubes (2*a*, 2*b*, 2*c*) are rigidly connected to each other by side lattices (3*a*, 3*b*, 3*c*) which are constructed from a relatively large number of tubular structural elements (4*a*, 4*b*, 4*c*). Cross braces (5*a*, 5*b*, 5*c*) connect the side lattices (3*a*, 3*b*, 3*c*) to a tube 6 arranged in side lattice 3*a*, whereby the lattice gains structural stiffness. Additional lattice elements can be added in order to build up sufficient stiffness.

Guide tubes (2*a*, 2*b*, 2*c*) are held in a fixed position relative to each other by the side lattices (3*a*, 3*b*, 3*c*) and the cross braces (5*a*, 5*b*, 5*c*), this such that guide tubes (2*a*, 2*b*, 2*c*) are arranged in a geometric pattern, this pattern being in the embodiment shown in FIG. 1 a triangle with a side of about 20 m. Any other geometric pattern is however possible, such as the square shown in FIG. 2, a polygon or a circle for instance.

Each guide tube (2*a*, 2*b*, 2*c*) comprises a cylindrical peripheral wall (23*a*, 23*b*, 23*c*) which is supported by a base plate (21*a*, 21*b*, 21*c*) and with which positioning framework 1 can find support on the underwater bottom. The dimensions of guide tubes (2*a*, 2*b*, 2*c*) can be selected within wide limits, but have in the shown embodiment a height of about 6 m.

Figure 2:
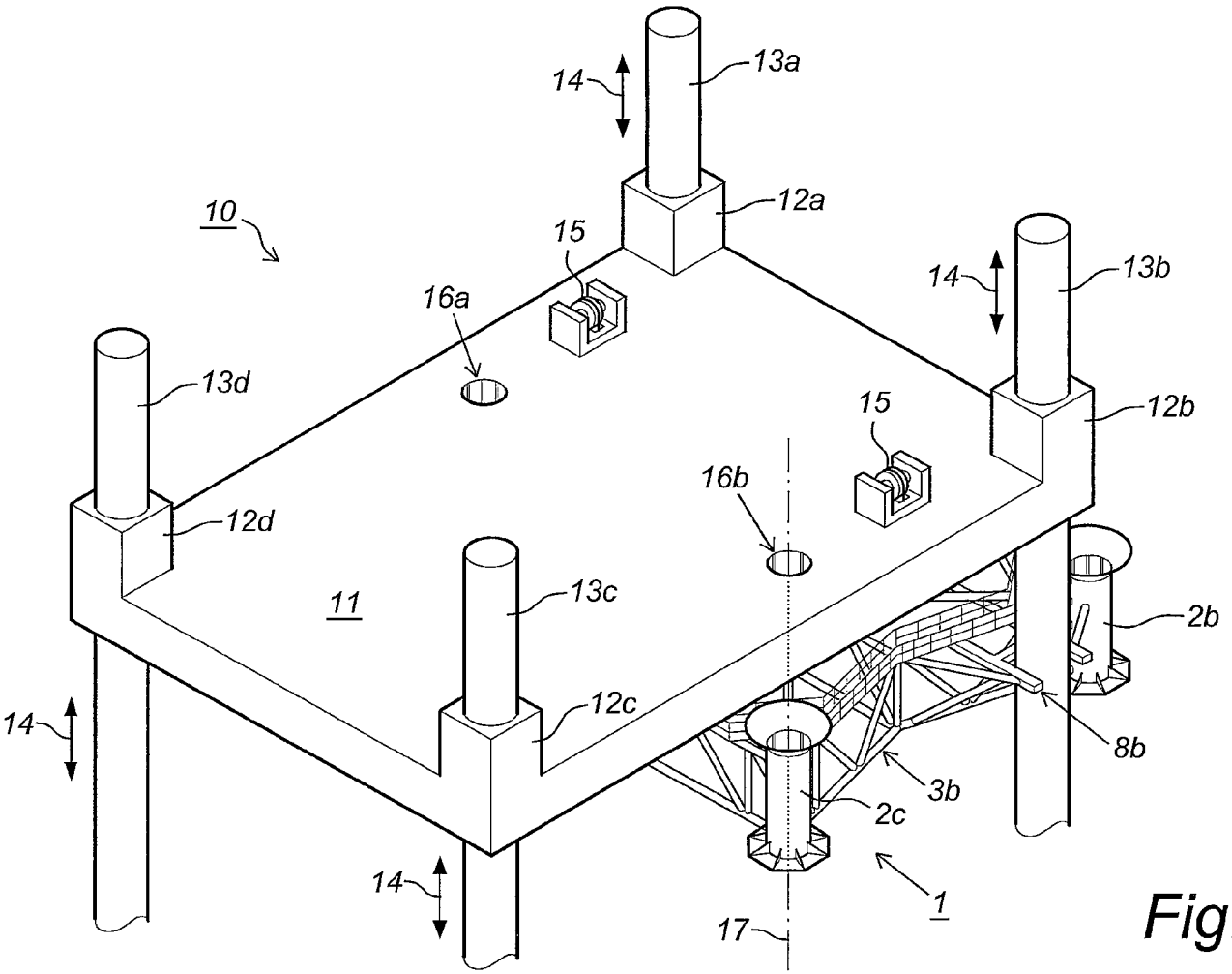
FIG. 2 shows a schematic perspective view of an embodiment of the jack-up platform adapted to be used in the method according to the invention.

Positioning framework 1 is further providing the means for guiding positioning framework 1 along the spud poles of an offshore platform shown in FIG. 2. In the embodiment shown in FIG. 1 these means comprise a structure with two U-shaped end forks (8*a*, 8*b*) which are fixedly connected to the rest of positioning framework 1 by means of tubular elements. Positioning framework 1 is positioned relative to platform 10 such that a spud pole (13*a*, 13*b*, 13*c*, 13*d*) of platform 10 is partially received in the space between the outer legs (9*a*, 10*a*, 9*b*, 10*b*) of the U-shaped end forks (8*a*, 8*b*), the space being large enough to be able to receive a spud pole. Positioning framework 1 can in this way be guided downward and/or upward along the spud pole(s). The means for guiding the positioning framework 1 along spud poles (13*a*, 13*b*, 13*c*, 13*d*) of the platform also comprise lifting means, such as winches 15 provided on the work deck of platform 10.

Figure 5A:
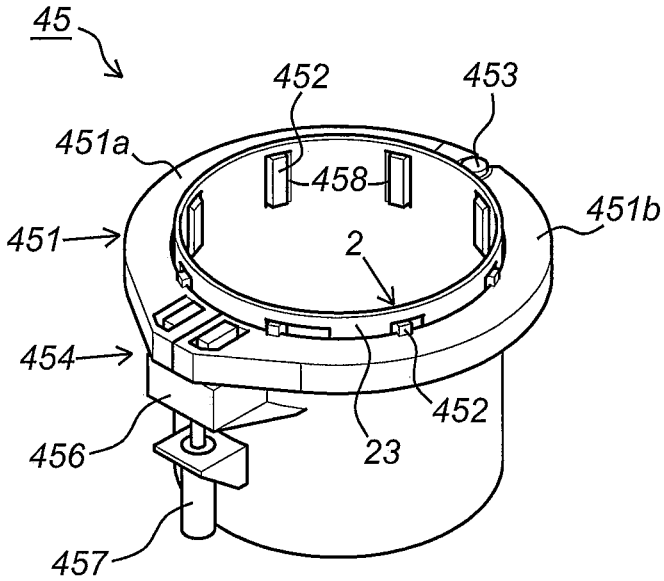
FIG. 5A-5D show schematically a third embodiment of a guide tube with displaceable internal wall part according to the invention.
Figure 5B:
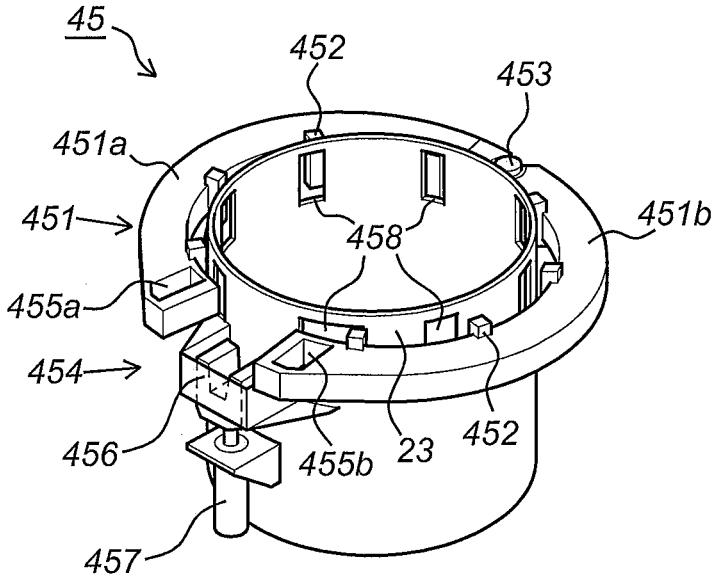
Figure 5C:
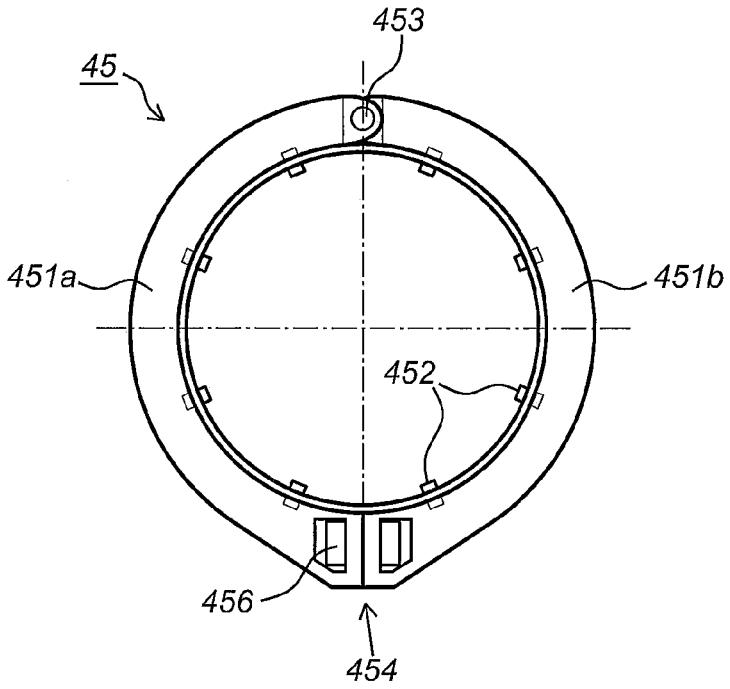
Figure 5D:
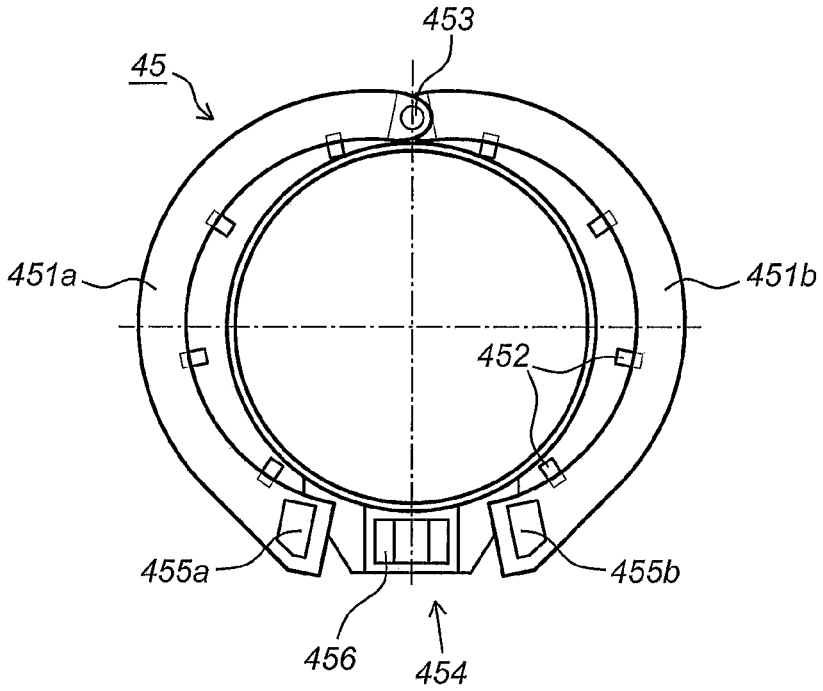
Figure 6:
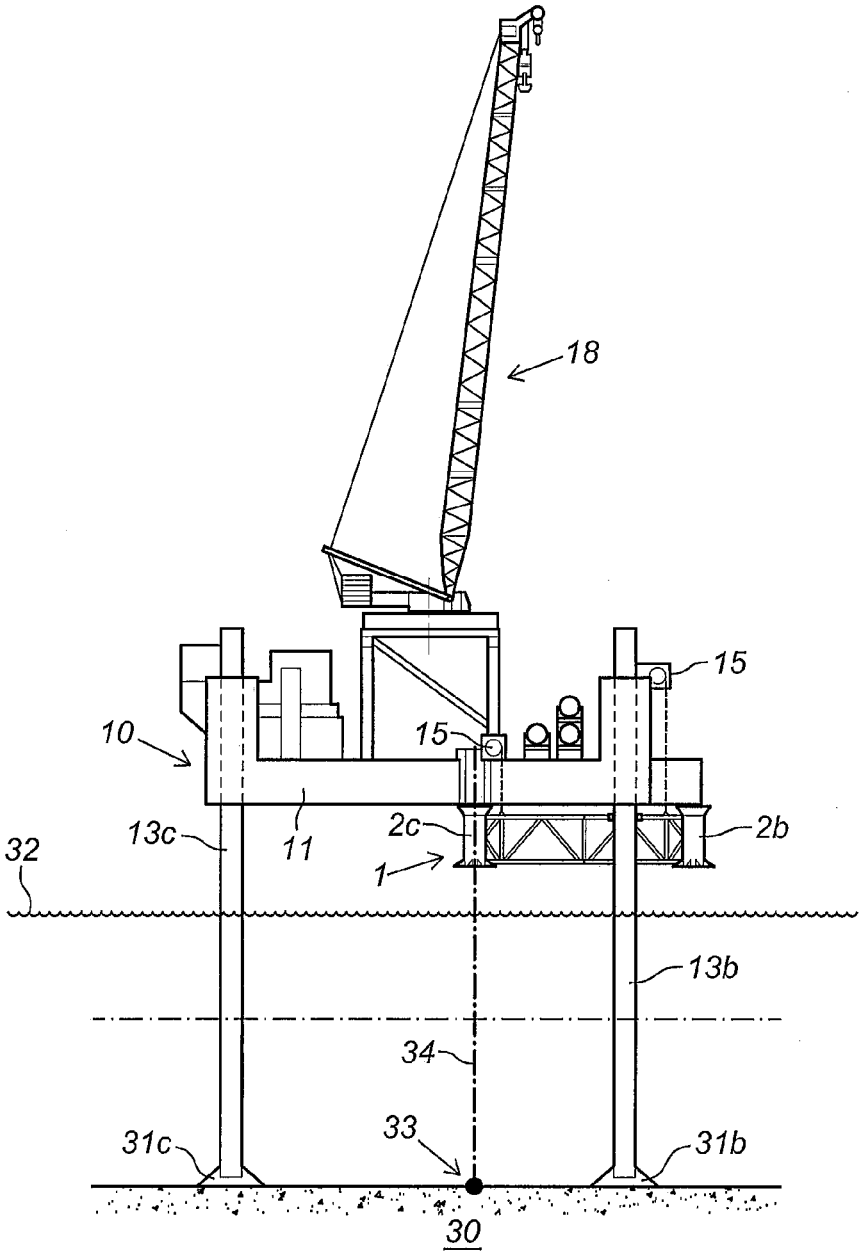
FIG. 6-12 show schematic side views of an assembly of platform and positioning framework in a number of positions occupied in different steps of the method.

A jack-up platform 10 adapted according to the invention is shown in FIG. 2. For reasons of clarity a number of structures, such as a lifting crane 18 (see FIGS. 3-9), normally present on a jack-up platform are omitted from the figure. Jack-up platform 10 comprises substantially a work deck 11 and four spud pole jacks (12*a*, 12*b*, 12*c*, 12*d*) at the corner points of work deck 11. Each jack (12*a*, 12*b*, 12*c*, 12*d*) operates a spud pole (13*a*, 13*b*, 13*c*, 13*d*) which can be lowered in the vertical direction 14 until the relevant spud pole finds support on underwater bottom 30 (FIG. 6). Work deck 11 is provided with winches 15 over which run cables which are connected to positioning framework 1. Using winches 15 the positioning framework 1 can be raised or lowered in the vertical direction 14. Platform 10 is further provided with two circular openings or moon pools (16*a*, 16*b*) which provide access to the water present under work deck 11 and which have a diameter which is large enough for passage of a foundation pile. Platform 10 thus carries the positioning framework 1, which in the shown preferred embodiment is provided on the underside of platform 10 in a rest position in the immediate vicinity of work deck 11 of platform 10. The assembly of platform 10 and positioning framework 1 is positioned such that moon pool 16*b* is vertically aligned with guide tube 2*c*, indicated in FIG. 2 with broken line 17.

According to the invention the guide tubes (2*a*, 2*b*, 2*c*) are adapted to receive and guide a pile (13*a*, 13*b*, 13*c*) to be driven into underwater bottom 30. Guide tubes (2*a*, 2*b*, 2*c*) comprise for this purpose a mechanism (25*a*, 25*b*, 25*c*) with which at least an internal wall part of the guide tubes is displaceable in the radial direction of guide tubes (2*a*, 2*b*, 2*c*) from a radially inward support position for the pile (13*a*, 13*b*, 13*c*) to a radially more outward position in which the internal wall part substantially releases the pile (13*a*, 13*b*, 13*c*). If desired, mechanism (25*a*, 25*b*, 25*c*) can be controlled from platform 10. The necessary provisions such as computers, electric power supplies, cabling and the like are present for this purpose, although these will not be discussed in further detail below.

Figure 3A:
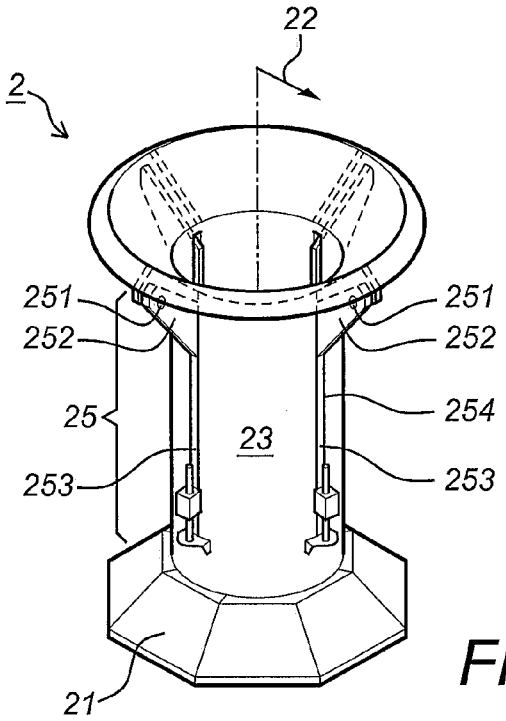
FIG. 3A-3C show schematically a first embodiment of a guide tube with displaceable internal wall part according to the invention.
Figure 3B:
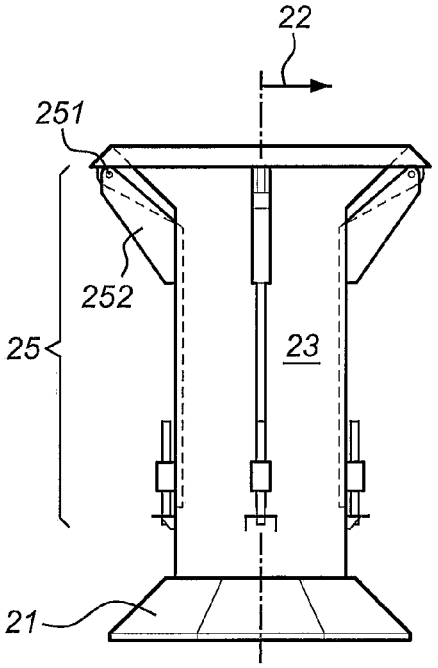
Figure 3C:
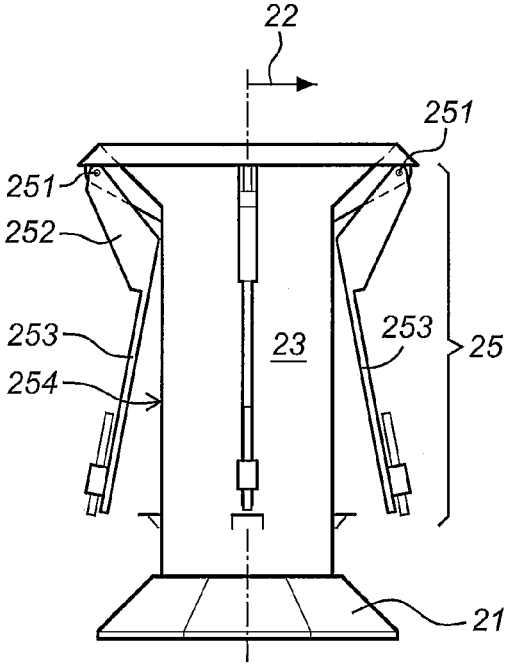

A first preferred embodiment of a guide tube 2 shown in FIGS. 3A-3C comprises the mechanism 25 described below. Mechanism 25 comprises a hinged plate 252 coupled for pivoting about a hinged connection 251 to guide tube 2. Attached to hinged plate 252 is a support rib 253 which can be received fittingly in a longitudinal channel 254 arranged in the cylindrical peripheral wall 23 of guide tube 2. By means of rotation of hinged plate 252 around hinged connection 251 the support rib 253 connected thereto can be displaced from a radially inward support position (the radial direction is indicated with direction 22) shown in FIG. 3B, wherein support rib 253 is received in channel 254, to a radially more outward position as shown in FIG. 3C, wherein support rib 253 is rotated away out of channel 254. In the support position the support ribs (four in the shown example) support a pile present in guide tube 2. Support ribs 253 extend substantially over the whole length of guide tubes 2.

Figure 4A:
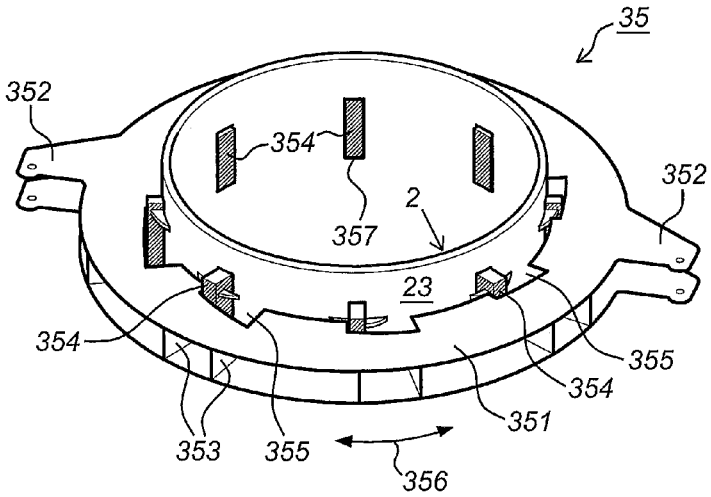
FIG. 4A-4C show schematically a second embodiment of a guide tube with displaceable internal wall part according to the invention.
Figure 4B:
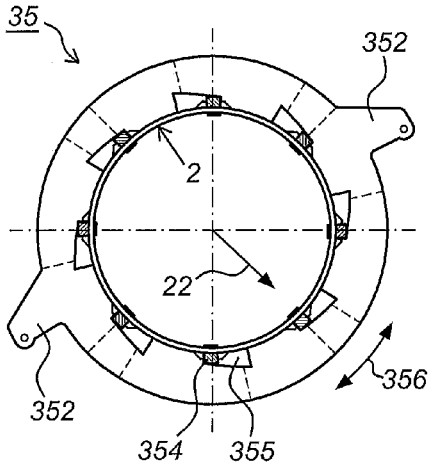
Figure 4C:
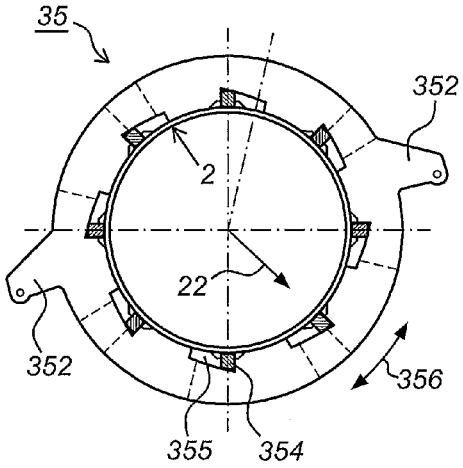

A second preferred embodiment of a guide tube 2 shown in FIGS. 4A-4C comprises the mechanism 35 described below. Mechanism 35 comprises a ring 351 in dual form which is arranged round peripheral surface 23 of a guide tube 2 (only a part is shown in FIG. 4A) and which is provided with rotating cams 352 and transverse strengthening plates 353 distributed in the peripheral direction. The outer surface of guide tube 2 is provided with a number of support ribs 354 which are arranged distributed in the peripheral direction and which are movable in radial direction 22. The inner peripheral surface of ring 351 is provided with a number of recesses 355, the radius of which varies in the peripheral direction 356. Support ribs 354 are coupled to the inner surface of recesses 355 so that a support rib 354 is displaced in radial direction 22 when ring 351 is rotated in peripheral direction 356. Support ribs 354 can be received fittingly in openings 357 arranged in the cylindrical peripheral wall 23 of guide tube 2. By means of rotating ring 351 in peripheral direction 356 the support ribs 354 coupled thereto can be displaced from a radially inward support position shown in FIG. 4B, wherein support ribs 354 are received in openings 357, to a radially more outward position shown in FIG. 4C, wherein support ribs 354 are rotated radially outward out of openings 357. In the support position the support ribs 354 support a pile present in guide tube 2.

A third preferred embodiment of a guide tube 2 shown in FIGS. 5A-5D comprises the mechanism 45 described below. Mechanism 45 comprises a ring 451 which is arranged round the peripheral surface 23 of a guide tube 2 (only a part is shown in FIG. 5A) and which is provided along its inner periphery with support ribs 452. The ring can be divided into two (as shown) or more ring parts (451*a*, 451*b*). Ring parts (451*a*, 451*b*) are pivotally coupled to guide tube 2 on a joined side by means of hinged connection 453. A ring closing mechanism 454 is provided on the opposite side of ring parts (451*a*, 451*b*). The ring closing mechanism 454 comprises holes (455*a*, 455*b*) which are arranged in ring parts (451*a*, 451*b*) and in which the legs of a closing block 456 can be received during closure as shown in FIG. 5A. Closing block 456 is connected for up and downward movement to casing surface 23 of guide tube 2 via the piston of a hydraulic cylinder 457. Support ribs 452 can be received fittingly in openings 458 which are arranged in the cylindrical peripheral wall 23 of guide tube 2 and which differ in width in the peripheral direction so as to be able to receive support ribs 452. By dividing the ring 451 from the closed position shown in FIGS. 5A and 5C the support ribs 452 coupled thereto can be displaced from a radially inward support position shown in FIGS. 5A and 5C, wherein support ribs 452 are received in openings 458, to a radially more outward position shown in FIGS. 5B and 5D, wherein support ribs 452 are rotated outward out of openings 458. In the support position the support ribs 452 support a pile present in guide tube 2.

An embodiment of the method according to the invention is shown in a number of steps in FIGS. 6 to 12. Referring to FIG. 6, the step is shown of determining the desired position 33 of a first pile for urging into the underwater bottom 30 and of positioning the assembly of platform 10 and positioning framework 1, this in a manner such that a guide tube (in the shown embodiment guide tube 2*c*) of positioning framework 1 is vertically aligned with said pile position 33, as represented schematically by broken line 34. Spud poles (13*a*, 13*b*, 13*c*, 13*d*) of platform 10 support in the fixed position on or partially in the underwater bottom 30 by means of removable feet (31*a*, 31*b*, 31*c*, 31*d*). Positioning framework 1 is held in position by winches 15 which operate lifting cables 36. In the rest position of positioning framework 1 the length of lifting cables 36 will be relatively short.

Figure 7:
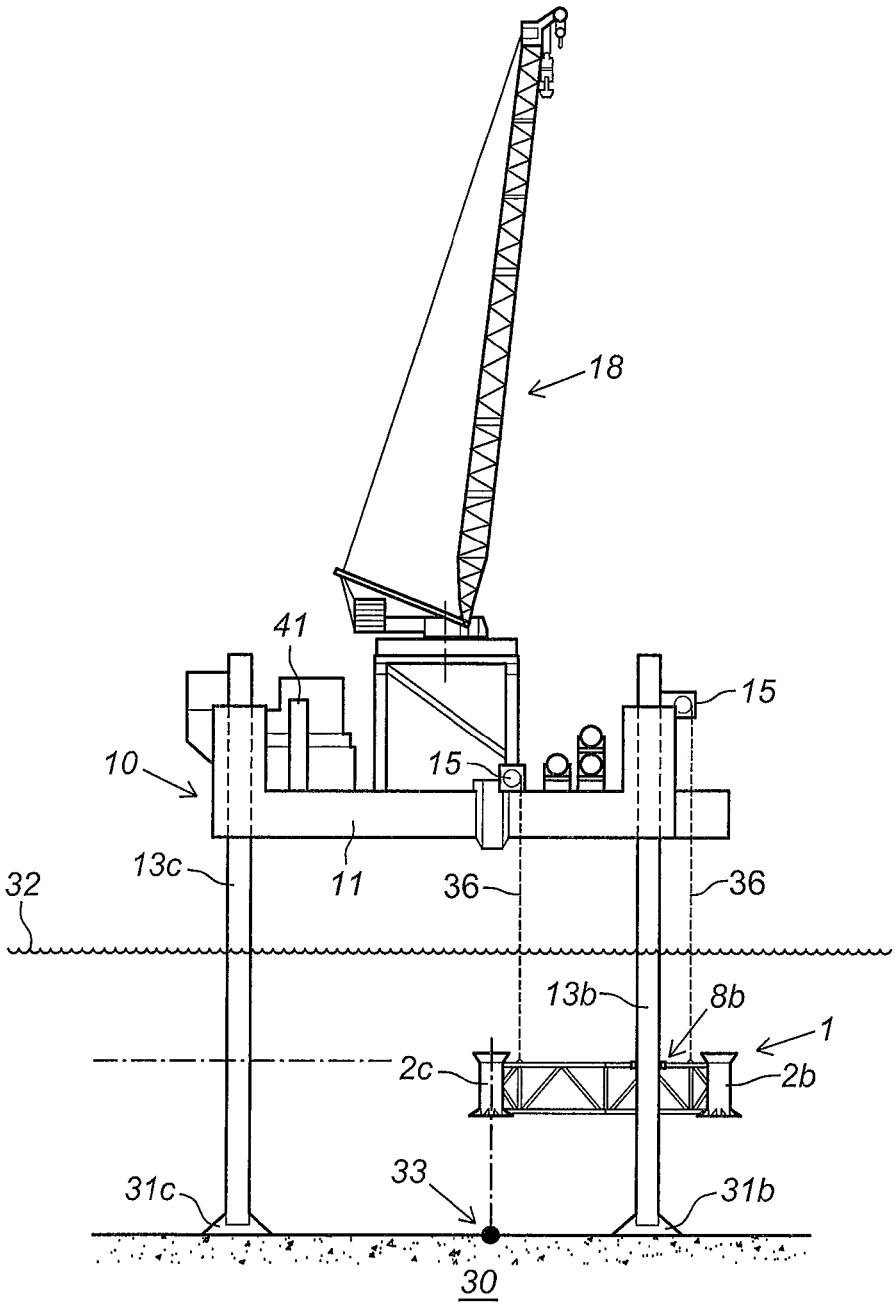
Figure 8:
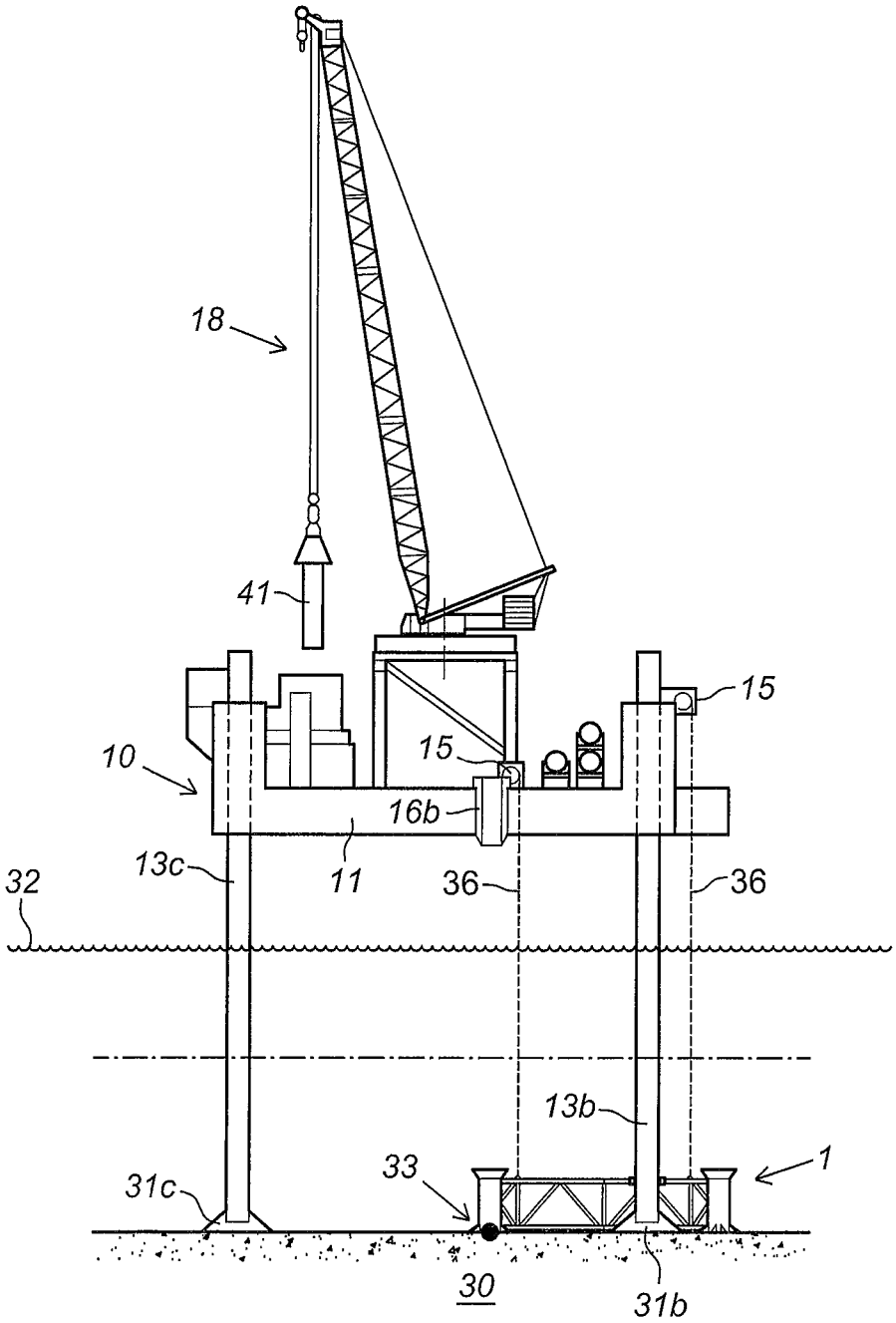
Figure 9:
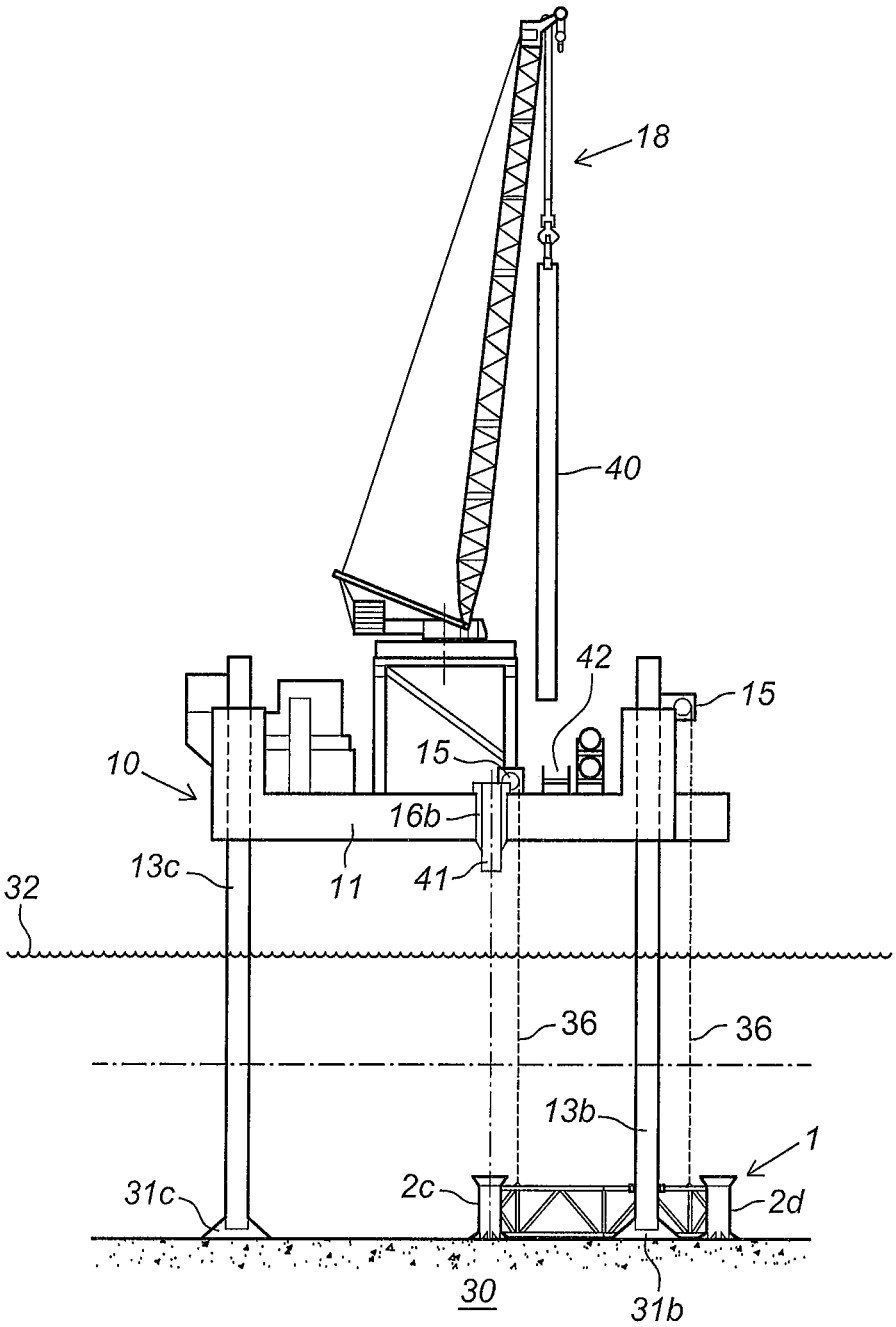

As shown in FIG. 7, positioning framework 1 is then lowered with winches 15 below the water surface 32 to a position of use, in which positioning framework 1 rests at least partially on underwater bottom 30 as shown in FIG. 8. During lowering the positioning framework 1 will slide with the U-shaped forks (8*a*, 8*b*) along spud poles (13*a*, 13*b*) so that its position in relation to platform 10 substantially does not change (except for the vertical position). Winches 15 operate independently of each other and are controlled such that positioning framework 1 is displaced substantially horizontally parallel to the spud poles. This ensures that foundation piles will be driven in a substantially vertical direction into underwater bottom 30, irrespective of the height profile of bottom 30. A pile lining tube 41 is then picked up by lifting crane 18 and placed in moon pool 16*b* above the desired position 33 of the first pile as shown in FIG. 8.

Figure 10:
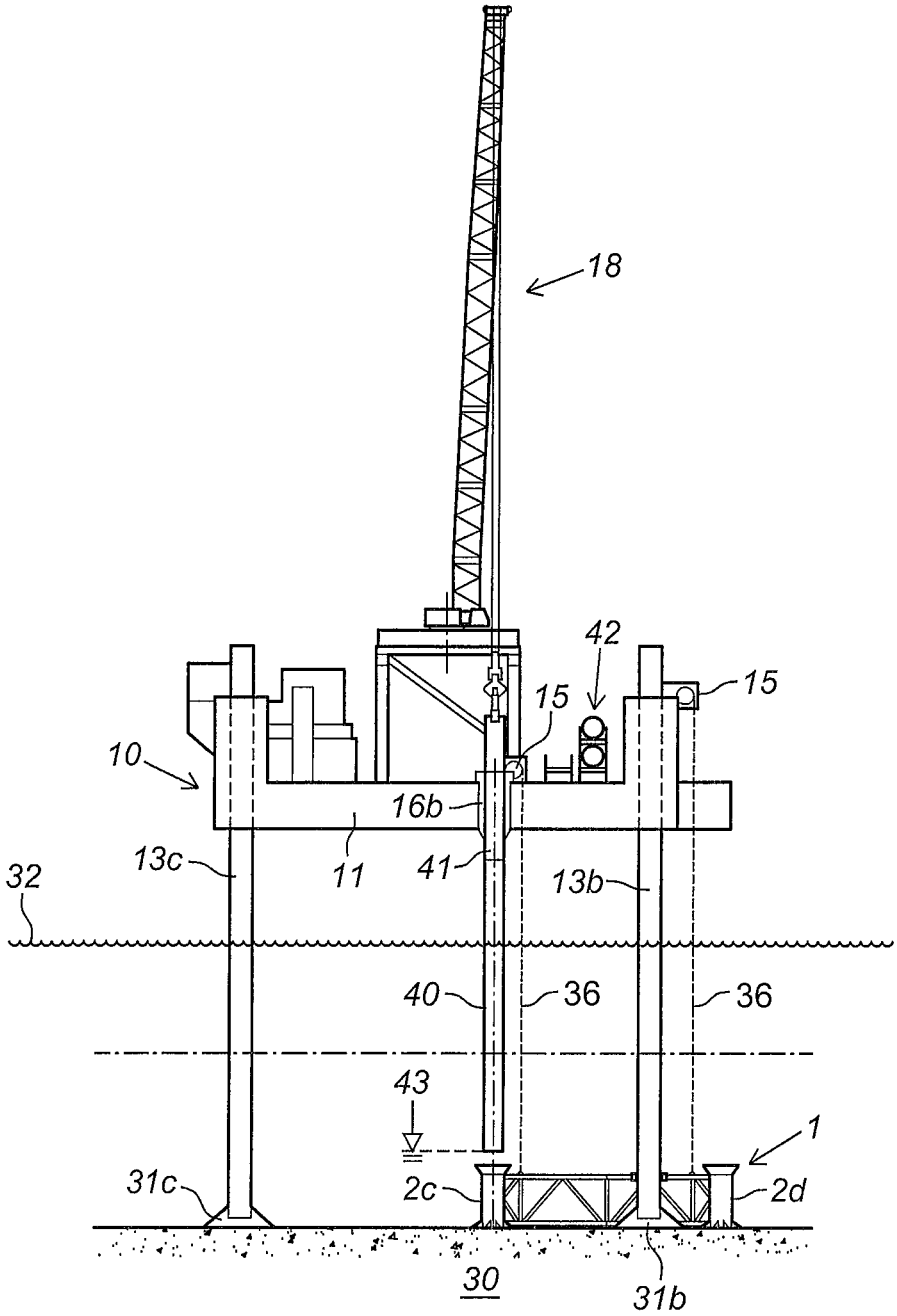
Figure 11:
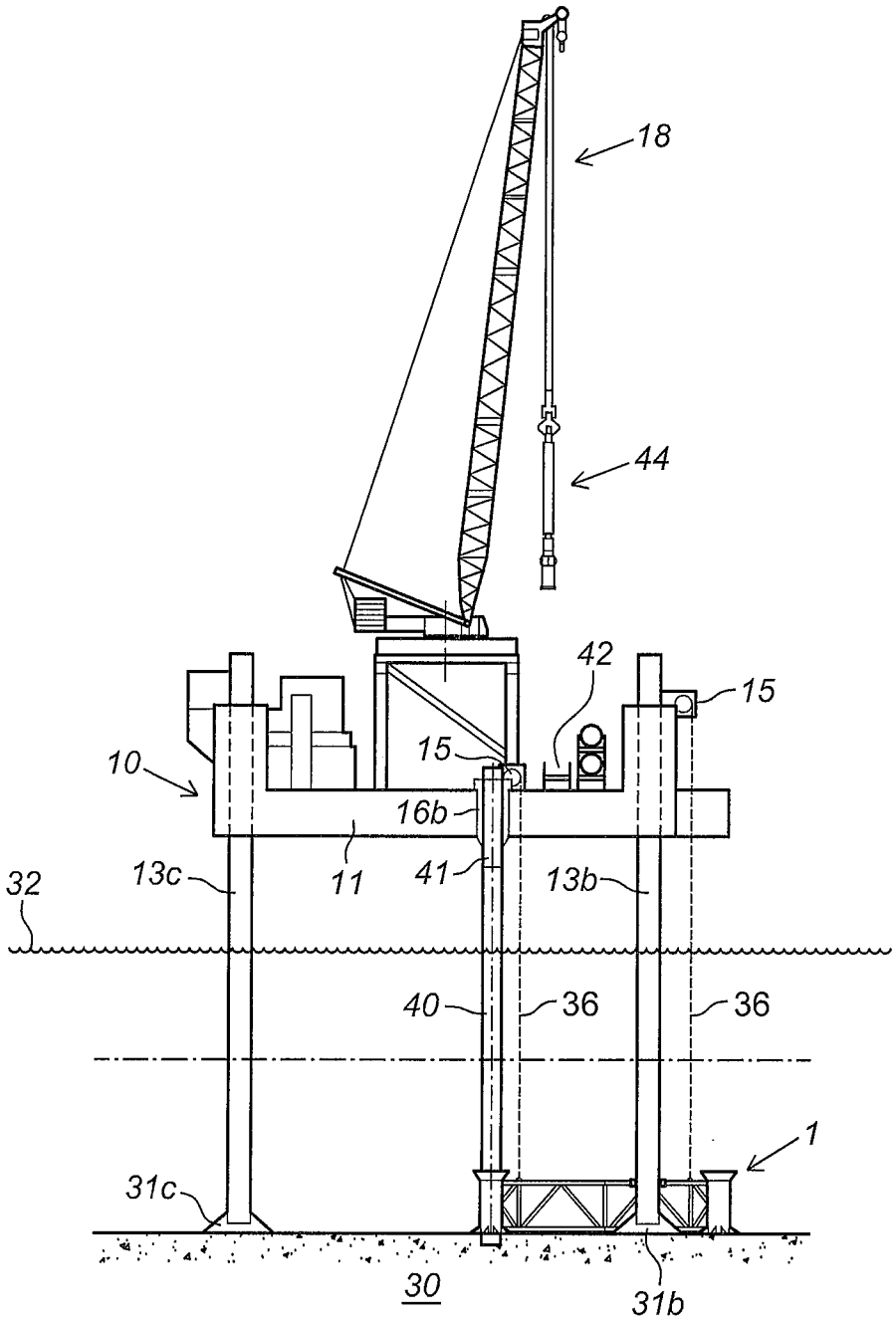

In a subsequent step of the method (see FIG. 9) a pile 40 is picked up by lifting crane 18 from a storage rack 42 and lowered into the lining tube 41 received in moon pool 16*b* until the underside of pile 40 is situated at the level 43, this level being close to the level of the underwater bottom (see FIG. 10).

Once pile 40 has been correctly aligned with guide tube 2*c*, the pile is lowered further until it is partially received in tube 2*c*. The support ribs (253, 354 or 452) are brought into the radially inward support position for pile 40, after which pile 40 is driven further into underwater bottom 30, wherein pile 40 is supported and guided by the support ribs of guide tube 2*c* (see FIG. 11).

Figure 12:
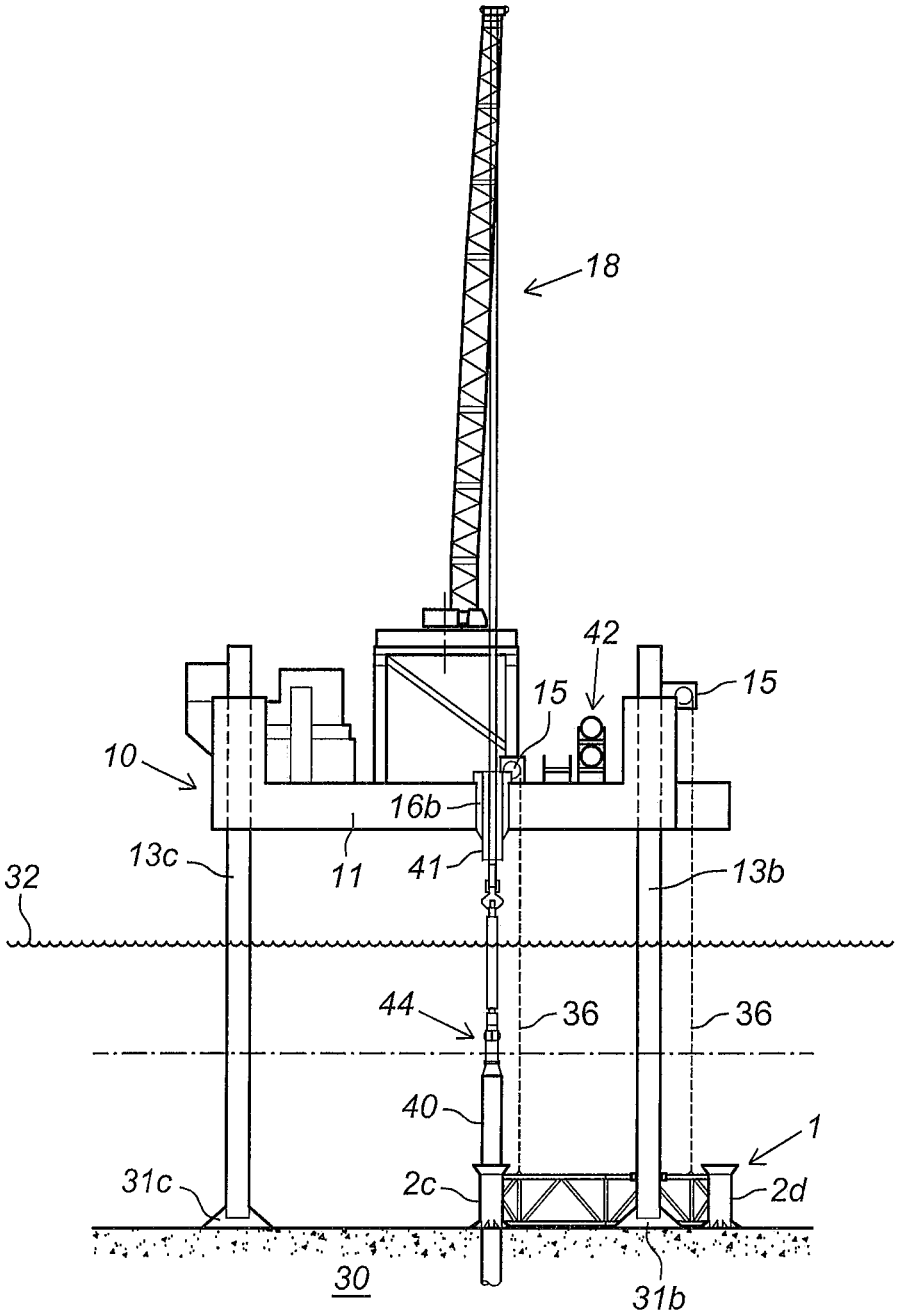

As shown in FIG. 12, pile 40 is driven into underwater bottom 30 until the top of pile 40 has penetrated far enough into guide tube 2*c*. Pile 40 can be driven into underwater bottom 30 by means of a pneumatic or hydraulic hammer 44.

The above described sequence of method steps is then repeated a number of times, depending on the desired number of foundation piles which must be arranged in underwater bottom 30. Because guide tubes (2*a*, 2*b*, 2*c*) of positioning framework 1 are automatically situated in the correct positions, all piles can be driven in efficient manner into underwater bottom 30 without losing time in determining the position for each individual pile. Once all piles 40 have been arranged in underwater bottom 30, positioning framework 1 can optionally be removed by being lifted along spud poles (13*a*, 13*b*) from the position of use to the rest position close to work deck 11 of platform 10 using winches 15 and lifting cables 36. In order to enable the removal of positioning framework 1 the support ribs (253, 354 or 452) are moved into the radially outward position, wherein the piles are released. If desired, the position of piles 40 and/or the vertical position of the top of each of the piles 40 can be checked using means suitable for the purpose prior to removal of positioning framework 1.

Figure 13:
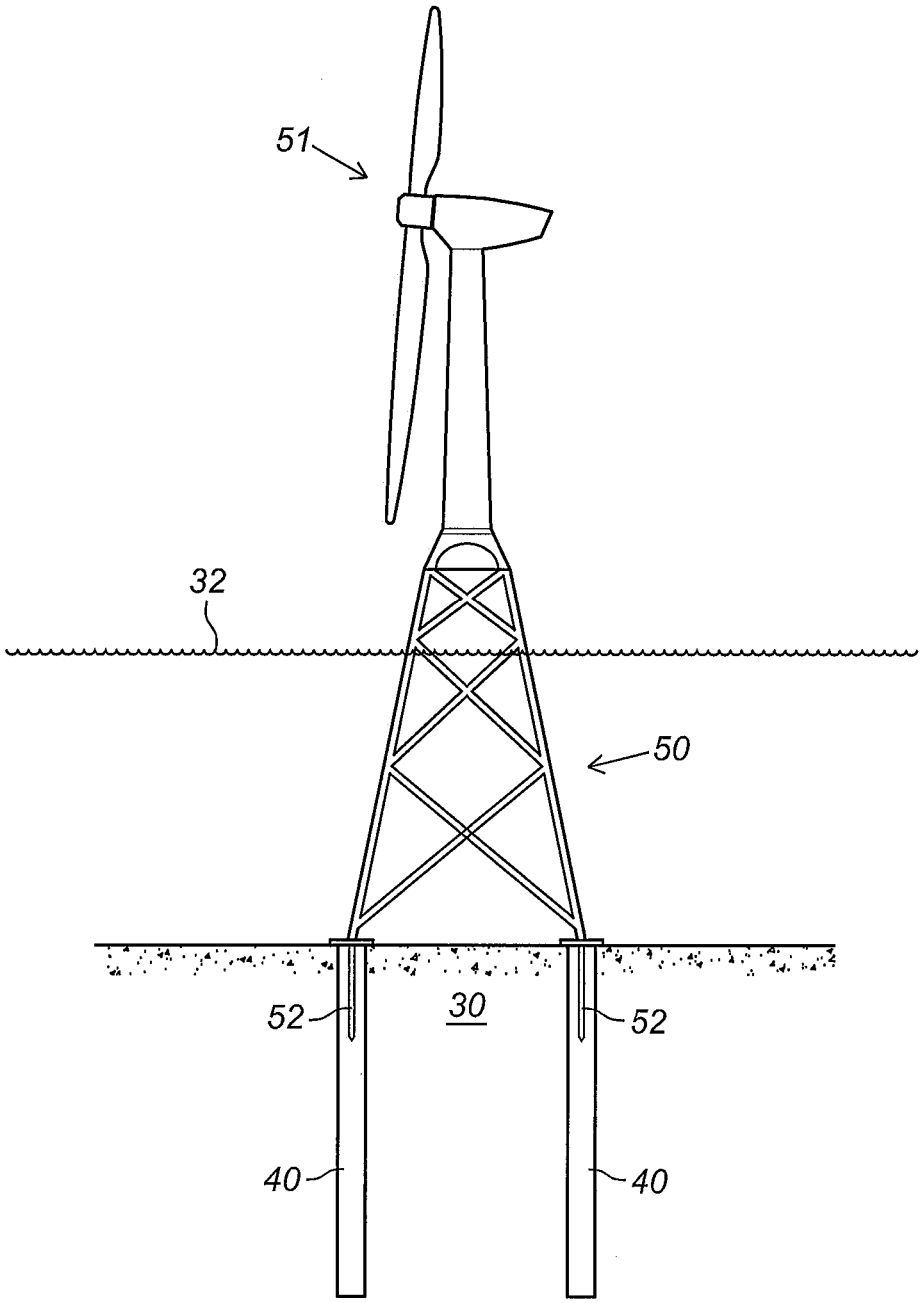
FIG. 13 shows schematically a jacket of a wind turbine placed according to the invention on a foundation of piles.

Referring to FIG. 13, a jacket 50 of a wind turbine 51 can be placed on the foundation realized as described above. This can take place for instance by arranging legs 52 of jacket 50 in or around piles 40 and anchoring the legs 52 to piles 40 by means of grouting.

The method and assembly of a platform and positioning framework according to the invention allow a pile foundation to be provided in efficient manner, wherein it is not necessary to displace the platform regularly for each pile, whereby much time is gained relative to the known method. The invented method is less dependent on weather conditions and requires in principle no extensive inspection operations underwater, for instance by robots and/or divers.

The invention claimed is:

1. A device for manufacturing a foundation for a mass located at height, wherein the foundation comprises a quantity of piles driven into an underwater bottom in a geometric pattern, said device comprising a positioning framework of a number of mutually connected guide tubes arranged in the geometric pattern and adapted to receive and guide a pile to be driven into the underwater bottom, wherein the guide tubes comprise a mechanism with which at least an internal wall part of the guide tubes is displaceable in a radial direction of the guide tubes from a radially inward support position for the pile to a radially more outward position in which the internal wall part substantially releases the pile, wherein the internal wall part of the guide tubes comprises support ribs extending substantially in the longitudinal direction of the guide tubes, wherein the mechanism comprises a ring outside of the internal wall, which when engaged, the ring moves the support ribs to a radially more inward position in the internal wall, and the guide tubes comprise recesses in a peripheral casing thereof, in which recesses the support ribs can be received.

2. The device as claimed in claim 1, wherein the internal wall part extends over the whole length of the guide tubes.

3. The device as claimed in claim 1, wherein the ring is arranged round a peripheral surface of the guide tubes and which is coupled along its inner periphery to the support ribs, wherein a radius of the inner periphery varies in peripheral direction so that at least one of the support ribs is displaced in radial direction when the ring is rotated.

4. The device as claimed in claim 1, wherein the ring is arranged round a peripheral surface of the guide tubes and which is provided along its inner periphery with the support ribs, and which can be divided into two or more ring parts so that a support rib is displaced in radial direction when the ring is divided.

5. The device as claimed in claim 4, wherein the ring further comprises ring parts which are pivotally coupled on a joined side to the guide tubes and on the other side comprise a ring closing mechanism.

6. The device as claimed in claim 1, wherein a height of the guide tubes amounts to at least 1 m.

7. The device as claimed in claim 1, wherein the positioning framework is further provided with at least three cables and at least one winch for guiding the positioning framework along spud poles of an offshore platform from a high position in an immediate vicinity of a work deck of the platform to a lower position.

8. The device as claimed in claim 1, wherein the device is coupled to a jack-up platform to form an assembly.

9. The device as claimed in claim 8, wherein a work deck of the platform is provided with at least one opening which is adapted for passage of at least one pile and which is vertically aligned with one of the guide tubes of the positioning framework.

10. The device as claimed in claim 1, wherein the mass located at height comprises a jacket of a wind turbine or a jetty.

11. A method for manufacturing a foundation for a mass located at height, wherein the foundation comprises a number of piles driven in a geometric pattern into an underwater bottom, the method comprising the steps of:

providing an assembly according to claim 8;

lowering the positioning framework along spud poles of the platform from a high position in an immediate vicinity of a work deck of the platform to a lower position on or in an immediate vicinity of the underwater bottom; and driving the piles into the underwater bottom through the guide tubes of the positioning framework in the lower position.

12. The method as claimed in claim 11, wherein the positioning framework is aligned substantially horizontally in the lower position.

13. The method as claimed in claim 11, wherein during driving of the piles into the underwater bottom through the guide tubes of the positioning framework an internal wall part of the guide tubes is situated in a radially inward support position for the pile.

14. The method as claimed in claim 11, comprising the step of removing the positioning framework once the piles have been arranged in the underwater bottom, wherein the removal of the positioning framework is performed by lifting thereof with guiding by the spud poles from the lower position to the high position in the vicinity of the work deck of the platform.

15. The method as claimed in claim 14, wherein during removal of the positioning framework the internal wall part of the guide tubes is situated in a radially more outward position in which the internal wall part substantially releases the pile.

16. The method as claimed in claim 11, wherein the mass located at height comprises a jacket of a wind turbine or a jetty.

17. A method for installing on a foundation a mass located at height, wherein the foundation comprises a number of piles arranged according to the method as claimed in claim 11 in an underwater bottom, the method comprising of arranging legs of the mass located at height into or around the piles and anchoring the legs to the piles by means of grouting.

18. The method as claimed in claim 17, wherein the mass located at height comprises a jacket of a wind turbine or a jetty.

19. A device for manufacturing a foundation for a mass located at height, wherein the foundation comprises a quantity of piles driven into an underwater bottom in a geometric pattern, said device comprising a positioning framework of a number of mutually connected guide tubes arranged in the geometric pattern and adapted to receive and guide a pile to be driven into the underwater bottom, wherein the guide tubes comprise a mechanism with which at least an internal wall part of the guide tubes is displaceable in a radial direction of the guide tubes from a radially inward support position for the pile to a radially more outward position in which the internal wall part substantially releases the pile, wherein the internal wall part of the guide tubes comprises support ribs extending substantially in the longitudinal direction of the guide tubes, and the guide tubes comprise recesses in a peripheral casing thereof, in which recesses the support ribs can be received, and wherein the mechanism comprises a hinged plate which is coupled pivotally to the guide tubes and to which at least one of the support ribs is attached, wherein the hinged plate is adapted, by means of rotation around a horizontal axis, to displace the support rib connected thereto from the radially inward support position to the radially more outward position.

* * * * *

UNITED STATES PATENT AND TRADEMARK OFFICE

CERTIFICATE OF CORRECTION

PATENT NO. : 8,926,226 B2
APPLICATION NO. : 13/401375
DATED : January 6, 2015
INVENTOR(S) : Luc Vandenbulcke et al.

It is certified that error appears in the above-identified patent and that said Letters Patent is hereby corrected as shown below:

Title page, Column 1, Item (75) Inventors, Line 1, delete "Konitch, (BE);" and insert
-- Kontich, (BE); --

Signed and Sealed this
Twenty-eighth Day of April, 2015

Michelle K. Lee

Michelle K. Lee
*Director of the United States Patent and Trademark Office*